US007197261B2

(12) United States Patent
Umeda et al.

(10) Patent No.: US 7,197,261 B2
(45) Date of Patent: Mar. 27, 2007

(54) LASER PRINTER

(75) Inventors: Yasuharu Umeda, Daito (JP); Atsunori Zensai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 120 days.

(21) Appl. No.: 11/148,693

(22) Filed: Jun. 9, 2005

(65) Prior Publication Data

US 2005/0281579 A1 Dec. 22, 2005

(30) Foreign Application Priority Data

Jun. 16, 2004 (JP) ..... 2004-178608

(51) Int. Cl.
*G03G 15/00* (2006.01)

(52) U.S. Cl. ..... 399/107; 399/124

(58) Field of Classification Search ..... 399/107, 399/110, 124, 111, 24, 27, 88, 90; 347/138, 347/152

See application file for complete search history.

(56) References Cited

U.S. PATENT DOCUMENTS

| | | | | |
|---|---|---|---|---|
| 6,796,736 | B1 * | 9/2004 | Shiraishi et al. | 399/110 X |
| 2002/0041775 | A1 * | 4/2002 | Ishii | 399/124 |
| 2003/0235428 | A1 * | 12/2003 | Suzuki et al. | 399/107 |
| 2004/0247337 | A1 * | 12/2004 | Ohama et al. | 399/107 |

FOREIGN PATENT DOCUMENTS

| | | | |
|---|---|---|---|
| JP | 05-262011 | A * | 10/1993 |
| JP | 11-305512 | A * | 11/1999 |
| JP | 2001-125331 | | 5/2001 |
| JP | 2002-72601 | | 3/2002 |
| JP | 2002-187324 | | 7/2002 |
| JP | 2003-200634 | | 7/2003 |

OTHER PUBLICATIONS

Patent Abstracts of Japan, Publication No. 2001-125331 dated May 11, 2001, 1 page.
Patent Abstracts of Japan, Publication No. 2002-072601 dated Mar. 12, 2002, 1 page.
Patent Abstracts of Japan, Publication No. 2002-187324 dated Jul. 2, 2002, 1 page.
Patent Abstracts of Japan, Publication No. 2003-200634 dated Jul. 15, 2003, 1 page.

* cited by examiner

*Primary Examiner*—Sophia S. Chen
(74) *Attorney, Agent, or Firm*—Osha-Liang LLP

(57) ABSTRACT

A laser printer has a connection rod arranged therein. A front door has an internal side provided with a front protrusion and a rear door has an internal side provided with a rear protrusion. The connection rod has one end provided with a switch. When at least one of the front and rear doors is open, the connection rod is biased toward its other end by a spring and the front protrusion does not abut against the connection rod's one end. When the front and rear doors are both closed, the connection rod slides toward its one end and the front protrusion abuts against the connection rod's one end to turn on the switch.

5 Claims, 5 Drawing Sheets

LASER PRINTER

BACKGROUND OF THE INVENTION

1. Field of the Invention

The present invention relates generally to laser printers and particularly to laser printers having front and rear doors.

2. Description of the Background Art

A conventional laser printer 101, as shown in FIGS. 10 and 11, has a front side with a front door 102 that can be opened and closed to handle sheet jams, exchange toner, and for similar maintenance. Laser printer 101 has a rear side with a rear door 104 opposite front door 102. Rear door 104 has an inner side provided with a sheet feed guide 104*b* feeding a sheet (not shown), accommodated in a tray 103, along an arrow to a printing unit 108.

Laser printer 101 is previously set so that closing front door 102 allows a toner cartridge (not shown) to be housed at a predetermined position. If the laser printer operates with front door 102 open, the toner cartridge is not housed at the predetermined position, and laser printer 101 has toner leaking therein, which can result in poor printing.

In contrast, if the laser printer operates with rear door 104 open, a sheet output from tray 103 would not be guided toward printing unit 108. Consequently, the sheet would cause a jam or be discharged outside laser printer 101.

Accordingly laser printer 101 is required to operate with front and rear doors 102 and 104 both closed. Japanese Patent Laying-Open Nos. 2001-125331, 2002-72601 and 2002-187324 propose a printer provided with a sensor detecting that doors provided at two adjacent side portions, respectively, are closed.

SUMMARY OF THE INVENTION

The present invention specifically proposes an arrangement that prevents a laser printer from operating with at least one of opposite, front and rear doors open, and it contemplates a laser printer ensuring that it operates with front and rear doors both closed.

The present laser printer includes a main body, front and rear doors, a connection rod, front and rear protrusions, a switch, and a spring. The main body houses a tray accommodating a sheet, and a printing unit printing on the sheet. The front door is provided at a front side of the main body for maintenance. The rear door is provided at a rear side of the main body opposite the front door and has a guide receiving the sheet from the tray to feed the sheet to the printing unit. The connection rod is arranged slidably back and forth between the front and rear doors. The front protrusion is provided at the front door and protrudes from the front door towards the connection rod to abut against one end of the connection rod. The rear protrusion is provided at the rear door and protrudes from the rear door toward the connection rod to abut against the other end of the connection rod. The switch is provided at one end of the connection rod and turned on by one of the front protrusion, located closer to one end of the connection rod, and the rear protrusion abutting against the switch. The spring exerts force to the connection rod to bias the connection rod from one end, provided with the switch, toward the other end. The connection rod and the switch are arranged such that when at least one of the front and rear doors is open, the connection rod is biased toward the other end and one of the front and rear protrusions does not abut against one end, and when the front and rear doors are both closed the connection rod slides toward one end and one of the front and rear protrusions abuts against one end to turn on the switch.

The connection rod and switch that slide as the front and rear doors are opened and closed allow a relatively simple structure to be used to ensures that a switch is turned on when the front and rear doors are both closed and that the laser printer performs a printing operation.

The present invention in another aspect provides a laser printer including a main body, first and second doors, a connection member, a switch, and a resilient element. The first door is provided to the main body. The second door is provided to the main body at a location opposite the first door. The connection member is arranged between the first and second doors. The switch is provided to any one of an end of the connection member and the first and second doors. The resilient element exerts force to the connection member to bias the connection member from a side with the switch toward that free of the switch. The connection member and the switch are arranged such that when at least one of the first and second doors is open the connection member is biased by the resilient element from the side with the switch toward that free of the switch to prevent the switch from turning on and when the first and second doors are both closed, the connection member abuts against the first and second doors to turn on the switch.

The connection member and switch that slide as the first and second doors are opened and closed allow a relatively simple structure to be used to ensures that a switch is turned on when the first and second doors are both closed and that the laser printer performs a printing operation.

More specifically the first and second doors are arranged at front and rear sides, respectively, of the printer.

Furthermore the switch is preferably arranged at the connection rod. Furthermore the resilient element is preferably a spring.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention in an embodiment provides a laser printer, as will be described hereinafter.

Figure 1:
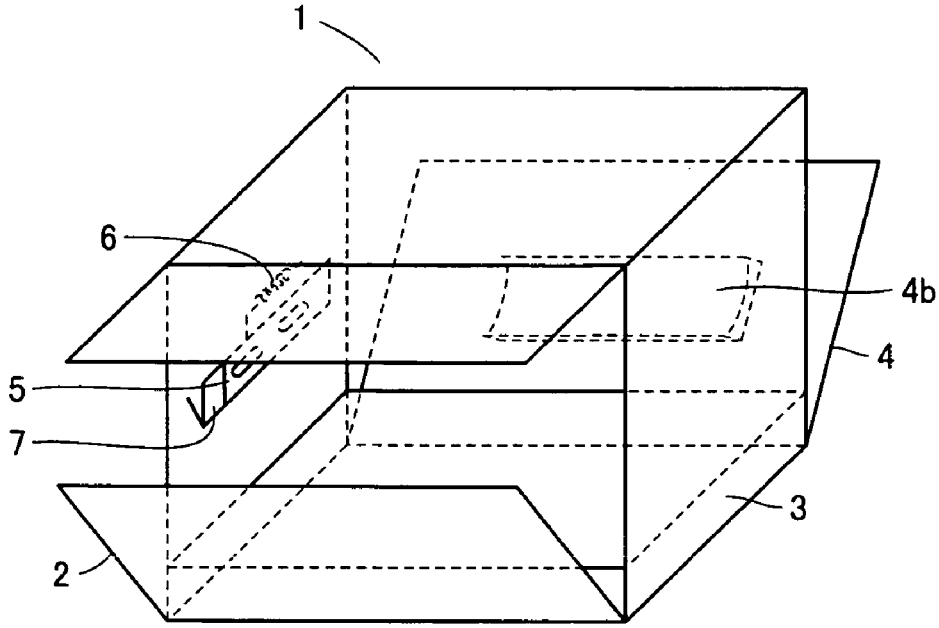
FIG. 1 is a perspective view of the present laser printer in an embodiment.
Figure 2:
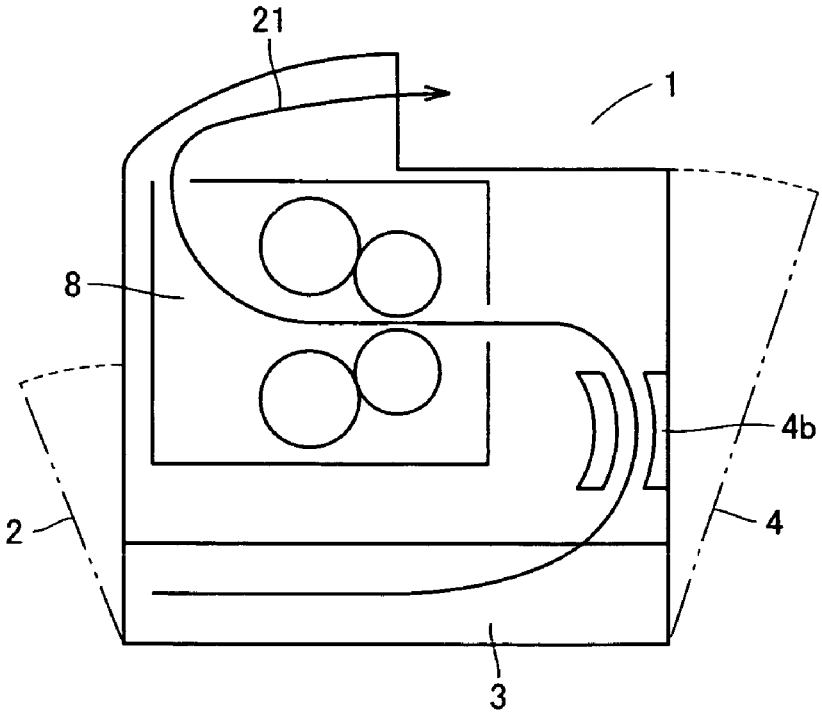
FIG. 2 is a side view showing in the embodiment how a sheet moves as the FIG. 1 laser printer performs a printing operation.

A laser printer 1, as shown in FIGS. 1 and 2, has a front side with a front door 2 that can be opened and closed to handle sheet jams, exchange toner, and for similar maintenance. Furthermore, laser printer 1 has a rear side with a rear door 4 opposite front door 2. Rear door 4 has an inner side provided with a sheet feed guide 4*b* feeding a sheet (not shown), accommodated in a tray 3, along an arrow 21 to a printing unit 8.

Figure 3:
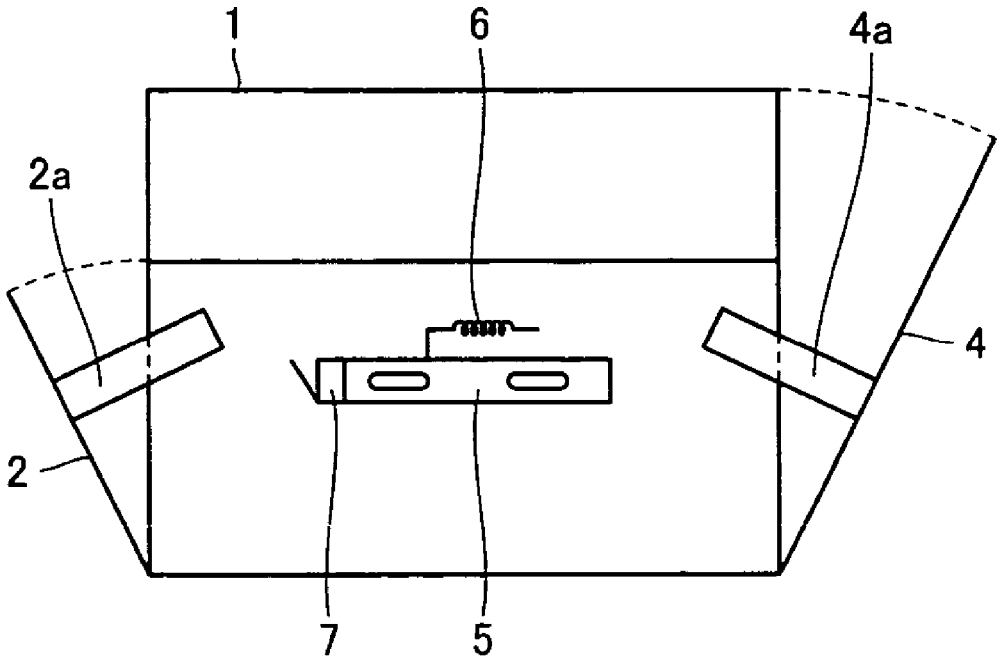
FIG. 3 is a side view showing in the embodiment how the FIG. 1 laser printer's front and rear doors move.

Furthermore, as shown in FIG. 3, the laser printer internally has a connection rod 5 arranged to be slidable back and forth as front and rear doors 2 and 4 are opened and closed. Front door 2 has an inner side with a front protrusion 2*a* protruding toward connection rod 5 to abut against one end of connection rod 5. Rear door 4 has an inner side with a rear protrusion 4*a* protruding toward connection rod 5 to abut against the other end of connection rod 5.

One end of connection rod 5 is provided with a switch 7 turned on by front protrusion 2*a* abutting against the switch. Connection rod 5 is biased toward its other end by a spring 6.

When at least one of front and rear doors 2 and 4 is open, connection rod 5 is biased from one end of connection rod 5 toward its other end and front protrusion 2*a* thus does not abut against one end of connection rod 5. When front and rear doors 2 and 4 are both closed, connection rod 5 slides toward its one end and front protrusion 2*a* abuts against one end of connection rod 5 to turn on switch 7.

Figure 4:
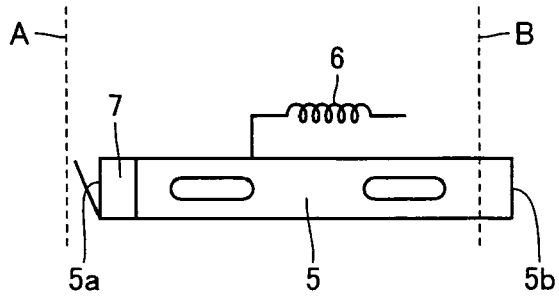
FIGS. 4–9 are first to sixth diagrams, respectively, for illustrating in the embodiment a relationship between the front and rear doors' respective movements and a connection rod's position.

Front and rear doors 2 and 4 are opened and closed and switch 7 turns on/off, as will be more specifically be described hereinafter. Initially, when the front and rear doors are both open, as shown in FIG. 4, connection rod 5 is biased by spring 6 from a front side, provided with switch 7, toward a rear side (i.e., rightwards as seen on the plane of the sheet of the drawing), and connection rod 5 will have one end 5*a* provided with switch 7 and the other end 5*b* at positions rearward of prescribed positions A and B, respectively. Positions A and B indicate the positions of one and the other ends 5*a* and 5*b*, respectively, of connection rod 5 with the front and rear doors both closed.

Figure 5:
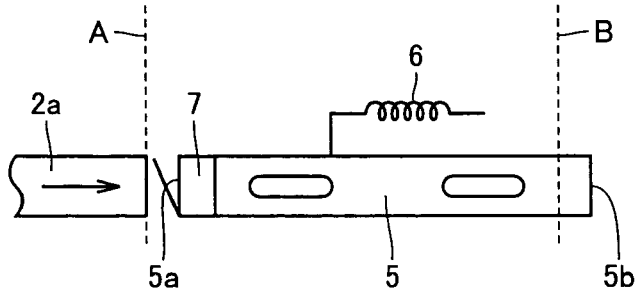

When the rear door is open and the front door is closed, then as shown in FIG. 5, the connection rod 5 have opposite ends 5*a*, 5*b* still positioned by spring 6 to be rearward of positions A and B, respectively. As such, if the front door is closed and front protrusion 2*a* reaches position A, the protrusion does not abut against switch 7. As such, switch 7 is not turned on.

Figure 6:
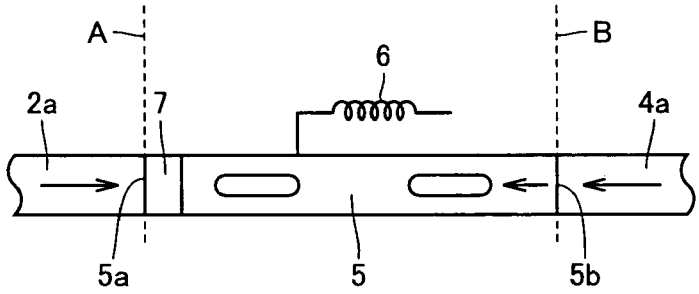

When the front door is closed and the rear door is also closed, then as shown in FIG. 6, rear door 4 has rear protrusion 4*a* abutting against the other end of connection rod 5 and connection rod 5 slides frontward, as indicated by an arrow, against the biasing force of spring 6. Thus connection rod 5 has its opposite ends reaching positions A and B, respectively, and switch 7 abuts against front protrusions 2*a* and thus turns on. In that condition laser printer 1 is allowed to operate.

Figure 7:
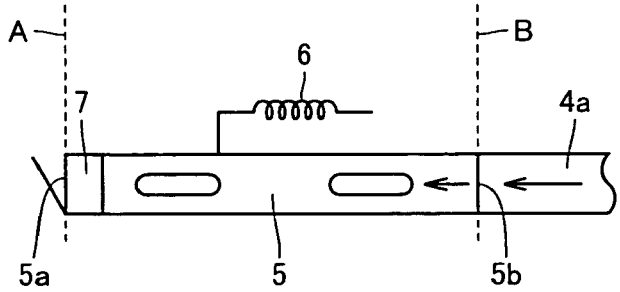

In contrast, when the front door is opened and the rear door is closed, then as shown in FIG. 7, rear door 4 has rear protrusions 4*a* abutting against the other end of connection rod 5 and connection rod 5 slides frontward, as indicated by an arrow, against the biasing force of spring 6. Thus connection rod 5 has its opposite ends reaching positions A and B, respectively. However, as the front door is open, switch 7 does not turn on.

Figure 8:
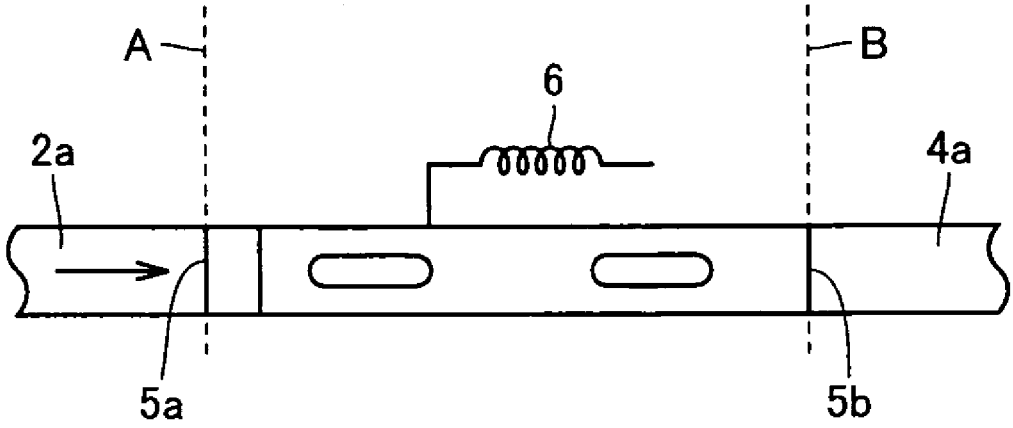

When the rear door is closed and the front door is also closed, then as shown in FIG. 8, front protrusion 2*a* abuts against and thus turns on switch 7. In that condition laser printer 1 is allowed to operate.

Figure 9:
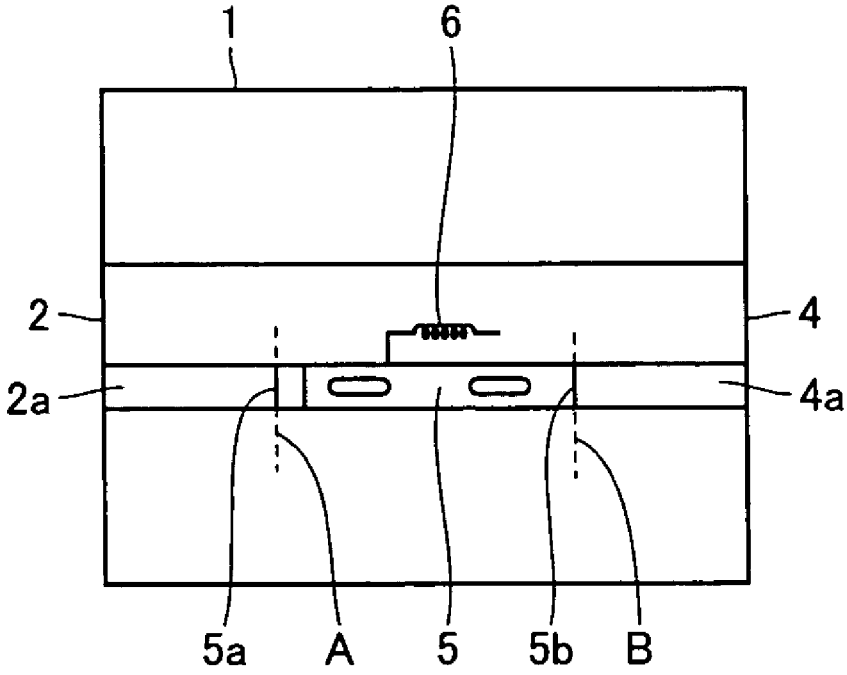
Figure 10:
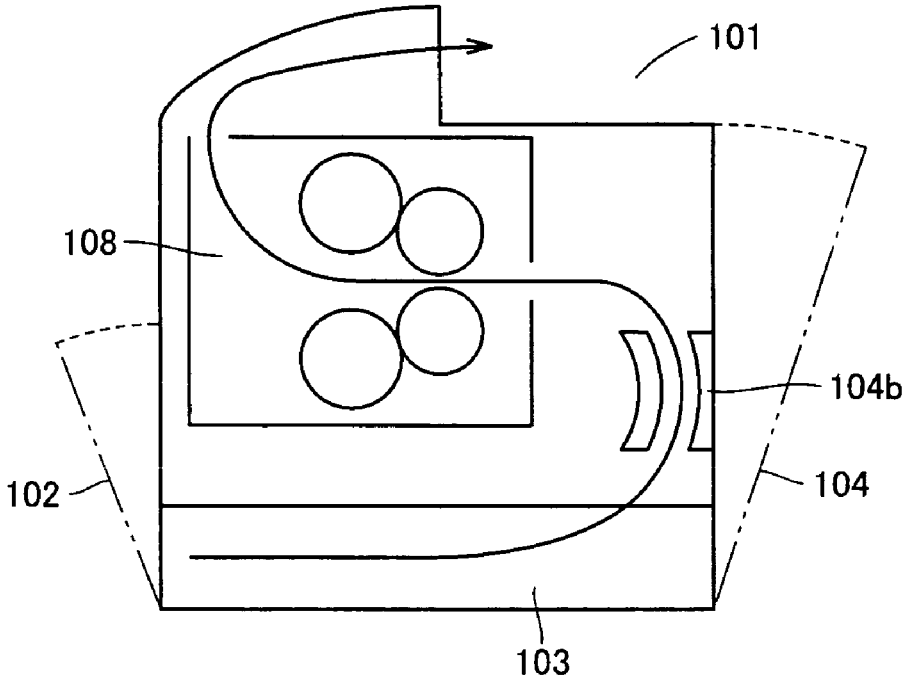
FIG.10 PRIOR ART
FIG. 10 is a perspective view of a conventional laser printer.
Figure 11:
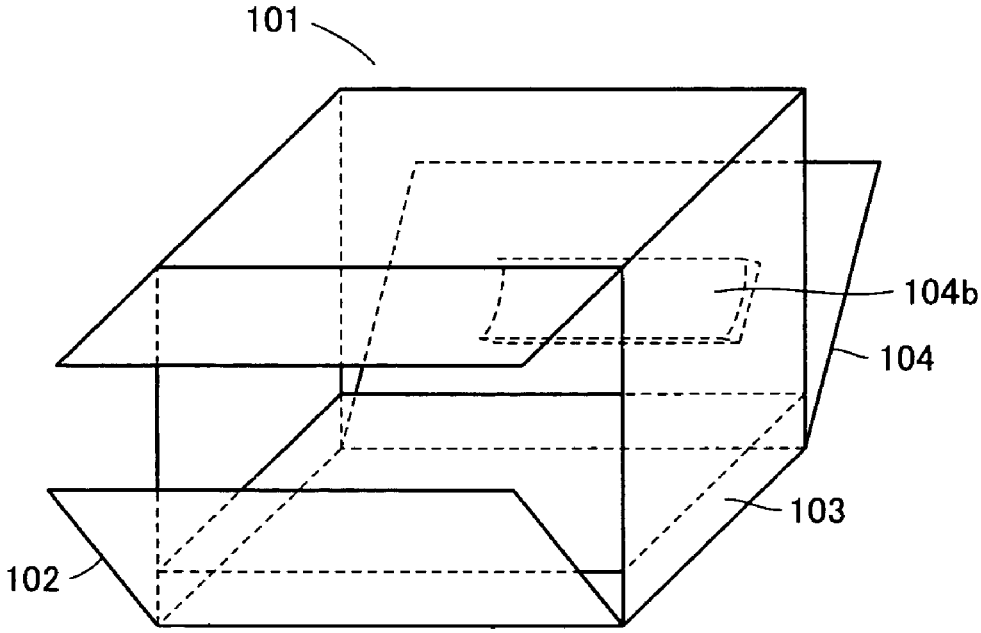
FIG.11 PRIOR ART
FIG. 11 is a side view showing how a sheet moves as the FIG. 10 laser printer performs a printing operation.

In the above described laser printer, as shown in FIG. 9, when front and rear doors 2 and 4 are both closed and connection rod 5 has opposite ends 5*a* and 5*b* at prescribed positions A and B, respectively, front protrusion 2*a* abuts against and thus turns on switch 7. In contrast, when at least one of front and rear doors 2 and 4 is open, connection rod 5 is biased by spring 6 in a prescribed direction to prevent the switch from turning on.

Thus a relatively simple structure ensures that a switch is turned on when front and rear doors 2 and 4 are both closed and that laser printer 1 performs a printing operation.

While in the above described laser printer 1 connection rod 5 has a front end provided with a switch, connection rod 5 may have a rear, other end provided with the switch. Furthermore, switch 7 may be arranged at front or rear protrusion 2*a* or 4*a*, rather than connection rod 5.

Furthermore while a resilient member is implemented by spring 6 by way of example for illustration, the resilient member is not limited to a spring if it can bias connection rod 5 in a prescribed direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser printer comprising:

a main body housing a tray accommodating a sheet, and a printing unit printing on the sheet;

a front door provided at a front side of said main body for maintenance;

a rear door provided at a rear side of said main body opposite said front door and having a guide receiving the sheet from said tray to feed the sheet to said printing unit;

a connection rod arranged slidably back and forth between said front and rear doors;

a front protrusion provided at said front door and protruding from said front door towards said connection rod to abut against one end of said connection rod;

a rear protrusion provided at said rear door and protruding from said rear door toward said connection rod to abut against the other end of said connection rod;

a switch provided at said one end of said connection rod and turned on by one of said front protrusion, located closer to said one end of said connection rod, and said rear protrusion abutting against said switch; and a spring exerting force to said connection rod to bias said connection rod from said one end, provided with said switch, toward said other end, wherein said connection rod and said switch are arranged such that:

when at least one of said front and rear doors is open, said connection rod is biased toward said other end and one of said front and rear protrusions does not abut against said one end; and when said front and rear doors are both closed said connection rod slides toward said one end and one of said front and rear protrusions abuts against said one end to turn on said switch.

2. A laser printer comprising:

a main body;

a first door provided to said main body;

a second door provided to said main body at a location opposite said first door;

a connection member arranged between said first and second doors;

a switch provided to any one of an end of said connection member and said first and second doors; and a resilient element exerting force to said connection member to bias said connection member from a side with said switch toward that free of said switch, wherein said connection member and said switch are arranged such that when at least one of said first and second doors is open said connection member is biased by said resilient element from the side with said switch toward the side free of said switch to prevent said switch from turning on and when said first and second doors are both closed, said connection member abuts against said first and second doors to turn on said switch.

3. The laser printer according to claim 2, wherein said first and second doors are arranged at front and rear sides, respectively, of said printer.

4. The laser printer according to claim 2, wherein said switch is arranged at said connection member.

5. The laser printer according to claim 2, wherein said resilient element is a spring.

* * * * *